United States Patent [19]

Berry

[11] 4,091,860

[45] * May 30, 1978

[54] WHEEL SPREADER AND CRACK CLOSER

[75] Inventor: Milton E. Berry, Carrollton, Ga.

[73] Assignee: Southwire Company, Carrollton, Ga.

[ * ] Notice: The portion of the term of this patent subsequent to Sep. 10, 1991, has been disclaimed.

[21] Appl. No.: 407,889

[22] Filed: Oct. 19, 1973

Related U.S. Application Data

[62] Division of Ser. No. 211,233, Dec. 23, 1971, Pat. No. 3,834,444.

[51] Int. Cl.[2] ..... B22D 11/06

[52] U.S. Cl. ..... 164/433; 164/87

[58] Field of Search ..... 164/87, 278, 429, 433, 164/434, 87; 72/221-235; 266/23 K

[56] References Cited

U.S. PATENT DOCUMENTS

| | | | |
|---|---|---|---|
| Re. 22,803 | 10/1946 | McLemore | 266/23 K UX |
| 1,034,361 | 7/1912 | Grey | 72/225 |
| 2,016,141 | 10/1935 | Geer | 72/221 |
| 3,464,483 | 9/1969 | Cofer et al. | 164/278 |
| 3,834,444 | 9/1974 | Berry | 164/276 X |

*Primary Examiner*—Francis S. Husar

*Attorney, Agent, or Firm*—Herbert M. Hanegan; Stanley L. Tate; Robert S. Linne

[57] ABSTRACT

This disclosure relates to a combined wheel spreader and crack closer adapted to maintain the predetermined draft angle of the casting groove of an open casting wheel while simultaneously working the interior surface thereof to close cracks and smooth out flaws therein during a casting operation. The wheel spreader includes rollers adapted to bear in rolling contact against the interior side walls of the casting groove, and the crack closer includes a roller adapted to bear in rolling contact against the bottom surface of the casting groove.

3 Claims, 5 Drawing Figures

FIG. 2
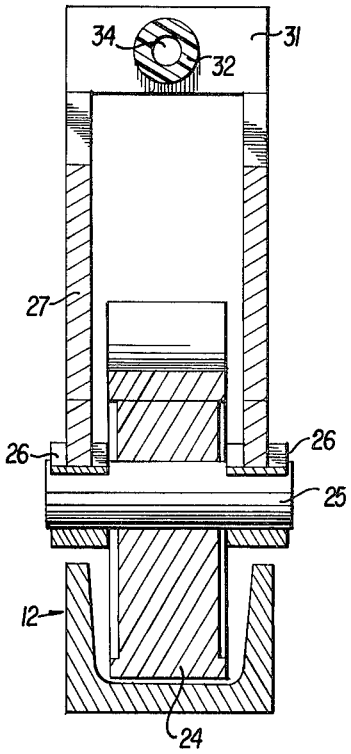
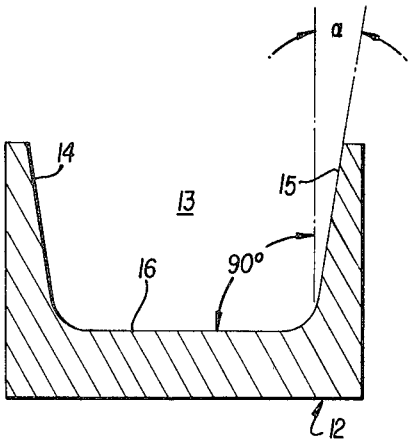
FIG. 4
FIG. 3
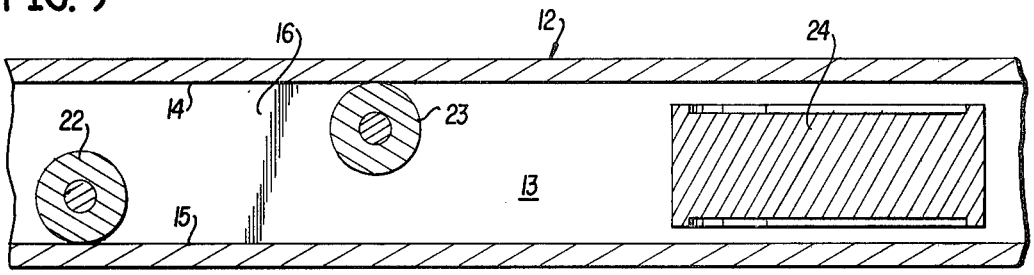
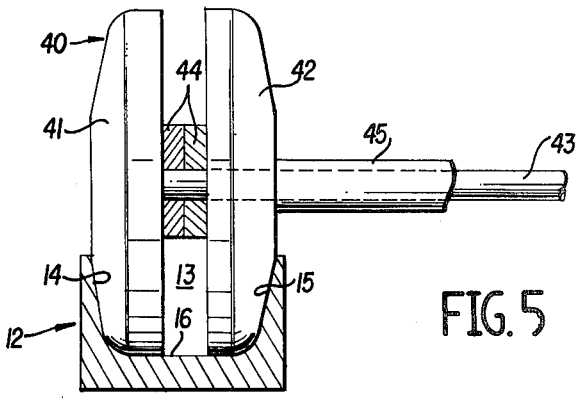
FIG. 5

WHEEL SPREADER AND CRACK CLOSER

This is a division of application Ser. No. 211,233, filed Dec. 23, 1971 now Pat. No. 3,834,444.

This invention relates to the metal forming art, and more particularly to apparatus for maintaining a casting wheel used in a continuous casting operation in a substantially smooth and trouble-free condition during the actual casting operation.

The invention contemplates the use of a combined wheel spreader and crack closer to maintain the predetermined draft angle of the casting groove of an open casting wheel while simultaneously working the interior surface thereof to close cracks and smooth out flaws therein during a casting operation.

Forming wheels used in the continuous casting of molten copper and other metals into solid metallic bar include a peripherally circumferential casting groove formed therein having two side walls and a bottom surface or floor extending therebetween. The angle defined between each of the side walls and the bottom surface is generally slightly obtuse to facilitate paying out of the cast bar from the groove. The amount that this angle exceeds 90° is termed the "draft angle" of the wheel. Generally, the draft angle is preferred in a range of approximately 10°–15°.

During the normal casting operation, the molten metal will tend to deposit and accumulate on the interior forming walls of the casting groove. Moreover, particularly during the casting of copper, the thermal loading of the wheel resulting from the depositing of molten metal thereon and the simultaneous operation of cooling it into a cast solid bar causes the side walls of the casting groove to "close in," thereby reducing the draft angle of the casting groove. If this process is permitted to continue unabated, the draft angle will be reduced to the point where the cast bar begins to stick in the wheel, thus obviously hindering the normal payout operation necessary to the continuous casting process.

Another problem inherent in the continuous casting of molten metal into solid bar is the rapid deterioration of the interior forming surfaces of the casting wheel resulting from the high temperatures and the thermal stresses developed therein. The heating of the wheel when in contact with molten metal tends to cause cracking, etc. on the interior forming surfaces thereof. When first formed, these fire-cracks, pit marks, scratches, etc. are usually very small and are located just at the surface of the casting groove. If left uncorrected, however, the initial fire-cracks, etc. grow larger by fatigue under the alternation of heating and cooling stresses at every revolution of the wheel. It should be apparent, therefore, that after a wheel has been left in service a sufficient length of time, the casting groove will tend to develop surface imperfections that will reproduce a corresponding pattern on the surface of the metal being cast by being periodically impressed thereon with each revolution of the wheel.

Inasmuch as the marks appearing at periodic intervals on the cast bar, as well as the uncontrollable variation in size and form thereof resulting from reduction of the draft angle of the casting groove, were sufficient in most cases to condemn the cast material, it was necessary at all times to maintain a careful inspection of the casting wheel and the material being produced. Heretofore, when the wheel deformation was such as to cause rejection of the produced material, when cracks occurred which could or did extend into the water jacket of the wheel, when cracks became large enough to cause the molten metal to penetrate therein, or when the draft angle simply was reduced to the point where the wheel "closed in" enough to make the cast bar stick in the casting groove, it was necessary to remove the wheel from operation and to grind and dress it to remove the surface imperfections and/or to restore the predetermined correct draft angle.

In certain casting machines, the wheels were changed every ten hours for copper wheels and every six hours for steel wheels and dressed in a special wheel shop. About 3/16 inch was taken from the surface of the wheels every time they were dressed, and it was necessary to keep on hand several sets of wheels to alternate for use in casting. It is known that the operation of wheel dressing is a highly specialized art which requires a high degree of care and skill and entails a great deal of time and expense. In order to secure the proper bar specifications, it is essential to maintain certain special conditions, carefully determined for every type wheel material during all stages of the dressing operation. Thus, it is necessary to determine the turning speed of the wheels undergoing grinding or cutting, the transverse speed of the tools or grinding wheels, the depth of the various cuts, etc. in order to avoid flats, traverse marks, "fish tails", "orange peel", and other marks. It is of extreme importance to carefully select the most suitable type of tools and abrasives and to have the operation controlled by a skillful operator. In order to avoid chatter marks, rigid non-vibrating machines are required plus, special spindles and methods of wheel mounting have been devised and the wheels have to be balanced carefully and accurately. Other factors to be observed are (1) the influence of the work temperature to avoid unequal expansion resulting in errors in dimension, (2) the type of lubricant for the various parts of the cutting or grinding operation, (3) the grinding wheel approach angle, and (4) the pressure of the tools or the grinding wheels and similar conditions.

As one skilled in the prior art can readily see, the surface imperfections which are formed on the surface of the wheel during casting operations can be removed only by methods which are expensive and require skillfully handled, expensive and lengthy operations. Furthermore, the rapid formation of fire-cracks, pits, scratches and the rapid accumulation of deposit metal on the interior forming walls of the casting wheel, especially when casting at high temperatures, requires frequent grinding operations which gradually reduce the diameter of the wheel. Under these circumstances, the life of the casting wheel is rather short, particularly in the case of chilled or other surface hardened wheels in which the hard surface is removed after a few grindings.

It is, therefore, a primary object of this invention to provide an apparatus for maintaining a casting wheel in a substantially smooth and trouble-free condition during the actual casting operation.

More particularly, it is an object of this invention to provide an apparatus for maintaining the predetermined draft angle of the casting groove of an open casting wheel while simultaneously working the interior surface thereof to close cracks and smooth out flaws therein during a casting operation.

Another object of this invention is to provide an apparatus which facilitates a method of maintaining a casting wheel in a substantially smooth and trouble free condition, which method is both inexpensive and not requiring advanced technical skill, while not removing the wheel from the casting operation.

A further object of this invention is to provide an apparatus for maintaining the correct predetermined draft angle of a casting wheel which eliminates the need for grinding the wheel, thus extending its useful life.

Briefly, these objects are accomplished by providing a combined wheel spreader and crack closer mounted in juxtaposed relation to the casting groove of an existing open casting wheel. The wheel spreader includes rollers adapted to exert pressure against the interior side walls of the casting groove during rotation of the wheel for removing metallic deposits therefrom and for maintaining the predetermined draft angle, while the crack closer includes a roller adapted to simultaneously exert pressure against the bottom surface of the casting groove for working the same to close cracks and to smooth out flaws therein.

With the above and other objects in view that will hereinafter appear, the nature of the invention will be more clearly understood by reference to the several views illustrated in the accompanying drawings, the following detailed description, and the appended claimed subject matter.

IN THE DRAWINGS

FIG. 2 is a vertical sectional view taken along line 2—2 of FIG. 1, and illustrates further details of the crack closer;

FIG. 3 is a fragmentary horizontal sectional view taken along line 3—3 of FIG. 1, and more clearly illustrates the two rollers comprising the wheel spreader engaging the opposite walls of the casting groove;

FIG. 4 is a radial sectional view taken through the casting groove and illustrates the draft angle defined by the interior side walls thereof, and FIG. 5 is a fragmentary elevation view of an alternate embodiment of the wheel spreader of this invention, and illustrates a split contoured roller adapted to simultaneously engage both side walls and the bottom surface of the casting groove.

Figure 1:
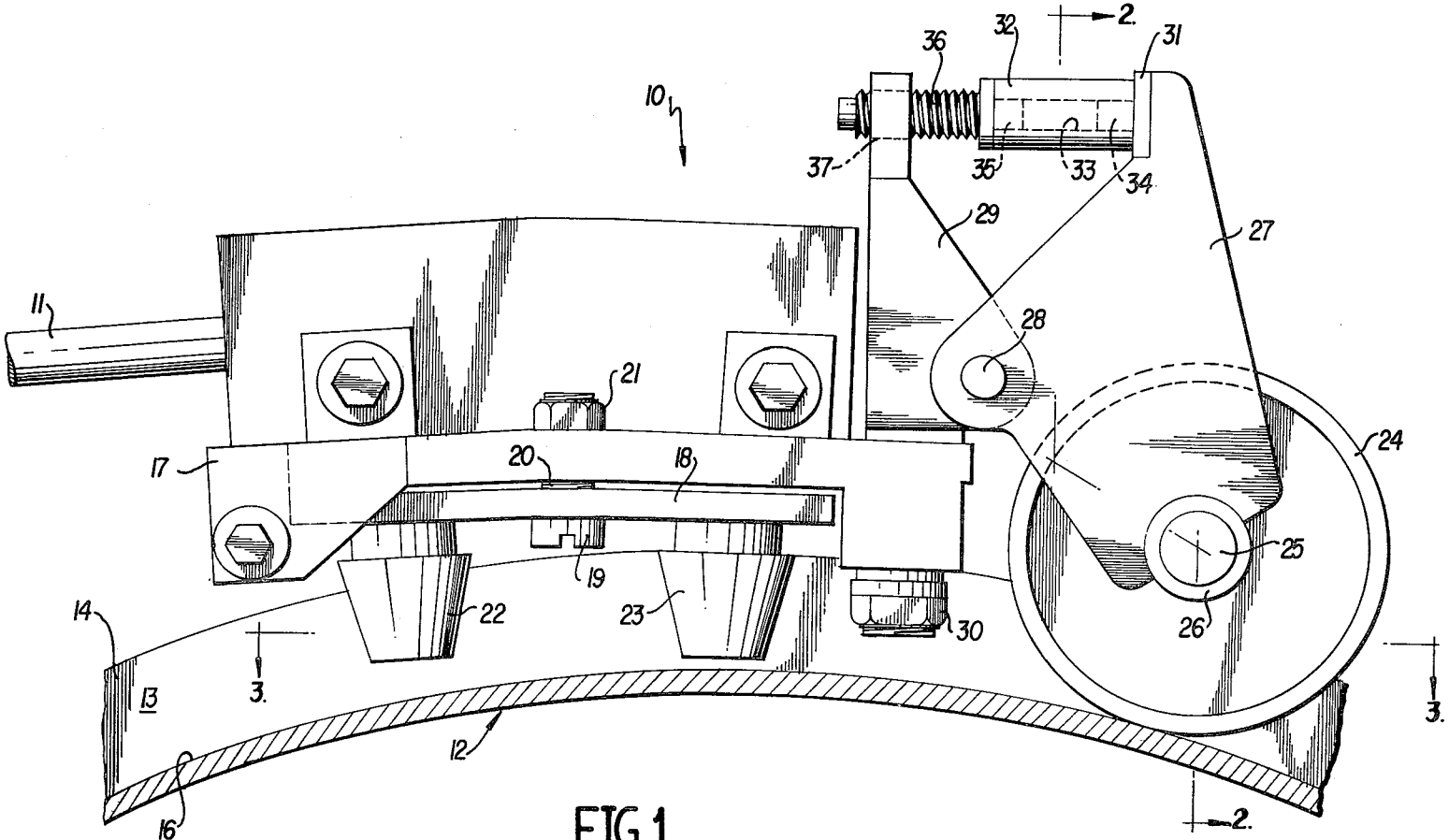
FIG. 1 is a fragmentary elevation view of the combined wheel spreader and crack closer of this invention mounted in relation to the casting groove of an open casting wheel, and has a portion of the casting wheel cut away to illustrate two tapered rollers engaging the interior side walls of the groove, and another roller engaging its bottom surface.

Referring now to the drawings in detail, there is illustrated in FIG. 1 a combined wheel spreader and crack closer apparatus designated generally by the numeral 10. The apparatus 10 is mounted by suitable means, such as support rods 11, in juxtaposed relation to a casting wheel 12 having an open casting groove 13. The casting wheel 12 is adapted to receive molten metal from a source (not shown) and cast it in the groove 13 in cooperation with other means, such as an endless belt (not shown), to produce solid metal bar, typically in a continuous process. The casting wheel 12 is provided with a cooling water jacket (not shown) by means of which the molten metal is cooled to form the solid final product.

The groove 13 is defined by interior side walls 14, 15 and a bottom surface or floor 16. As seen most clearly in FIG. 4, each of the side walls 14, 15 form a slightly obtuse angle with the bottom surface 16 of the groove 13, that portion of which exceeding 90° being termed the draft angle $\alpha$ of the wheel 12. As explained above, the alternate heating and cooling of the wheel 12 caused by the deposition of the molten metal in the groove 13 and its subsequent cooling establish thermal stresses therein which cause the side walls 14, 15 to "close in" toward each other, thereby reducing the draft angle, $\alpha$, as well as causing fire cracks, pit marks, scratches, etc. to form on the interior surfaces of the side walls 14, 15 and the bottom surface 16. As will become evident, the combined wheel spreader and crack closer apparatus 10 is adapted to inhibit these effects and to maintain the wheel 12 in a substantially smooth and trouble-free condition during the actual casting operation.

The apparatus 10 includes a frame 17 upon which is pivotally mounted an arm 18 by means of a bolt 19. The arm 18 is spaced from the frame 17 by a washer 20 carried by the bolt 19 and may be fixed and secured in any angular position relative to the frame 17 by means of a nut 21. The arm 18 carries two tapered rollers 22, 23 which are rotatably mounted thereon by suitable means. The rollers 22, 23 are adapted to be received within the groove 13 and to bear in rolling contact against the side walls 14, 15, respectively. The taper angle of the rollers 22, 23 corresponds to the draft angle $\alpha$ of the wheel 12 so that there is line contact therebetween. Alternatively, the rollers 22, 23 may be cylindrical and mounted on the arm 18 at an angle corresponding to the draft angle $\alpha$ so as to maintain the line contact. The pressure with which the rollers 22, 23 bear against the side walls 14, 15 may be adjusted, of course, by altering the angular position of the arm 18 using bolt 19 and nut 21.

The apparatus 10 also includes a hardened roller 24 adapted to be received within the groove 13 and to bear in rolling contact against its bottom surface 16. The roller 24 is rotatably mounted by means of a shaft 25 journalled in bearings 26 carried by a yoke 27. The yoke 27 is pivotally mounted by means of a pin 28 on a support bracket 29 which is, in turn, pivotally supported on the frame 17 and secured by a bolt 30.

The yoke 27 includes a traverse 31 upon which is mounted a resilient rubber grommet 32. The grommet 32 has an axial bore 33 formed therein. A stud 34 extends from the traverse 31 into one end of the bore 33 for mounting the grommet 32. Another stud 35 extends from an adjusting screw 36 into the other end of the grommet 32. The screw 39 extends from a threaded hole 37 formed in the support bracket 29.

It should be apparent, therefore, that the roller 24 may be spring biased against the bottom surface 16 by means of the resilient nature of the grommet 32. The pressure with which the roller 24 bears against the bottom surface 16 may be adjusted, of course, by means of the screw 36. Although the resilient grommet 32 is specifically illustrated herein, it is contemplated that other type spring-biasing means could be used within the scope of the invention.

In an alternate embodiment of the invention illustrated in FIG. 5, a split contoured roller 40 may be utilized in place of the rollers 22, 23. The roller 40 includes half rollers 41, 42 which are shaped and contoured to simultaneously bear in rolling contact against both the side walls 14, 15 and a portion of the bottom surface 16 of the casting groove 13. The half rollers 41, 42 are rotatably mounted on a shaft 43 which may be supported by the frame 17. Suitable shims 44 are provided to space the half rollers 41, 42 apart from one another in accordance with the specific width of the casting groove 13 and the degree of pressure intended to be applied. A sleeve 45 is provided to secure the device in assembled condition. The split contoured roller 40 may be used in combination with the roller 24, or may provide sufficient working itself of the bottom surface 16 such as to eliminate the need for the roller 24.

The operation of the apparatus 10 should be apparent from its foregoing description. During rotation of the casting wheel 12, while performing a casting operation or otherwise, the rollers 22, 23 (or the contoured roller 40 of the embodiment of FIG. 5) and the roller 24 will bear in rolling contact against the interior forming surfaces of the casting groove 13, thus applying pressure thereto. The rollers 22, 23 are adapted to bear outwardly against the side walls 14, 15 for "spreading" or resisting their tendency to "close in" under the force of the thermal stresses. The predetermined draft angle $\alpha$ is thus maintained during the casting operation. Moreover, the working of the rollers 22, 23 against the side walls 14, 15 tends to inhibit the build-up of metal deposits which normally form on the interior surfaces of the casting groove 13 and which further contribute to the "closing in" effect of the side walls 14, 15. The ability to resist the formation of these deposits at their inception eliminates the need to remove the wheel 12 from operation to grind the groove 13 to restore the correct draft angle.

Similarly, fire cracks, scratches, pit marks, etc. which form on the bottom surface 16 of the groove 13 are closed and smoothed out by the working of the roller 24. This operation also is accomplished at each and every revolution of the wheel 12, and may be performed during the actual casting operation itself.

It should be apparent, therefore, that there is provided in accordance with this invention an apparatus for maintaining a casting wheel in a smooth and trouble-free condition during the actual casting operation. The apparatus facilitates maintenance of the correct draft angle of the casting groove while simultaneously working the interior surface thereof to close cracks and smooth out flaws therein, thereby assuring continuous presentation of a substantially smooth and unmarked forming surface to the metal being cast.

Although only preferred embodiments of the invention have been specifically illustrated and described herein, it is contemplated that minor modifications could be made without departing from the spirit of the invention.

I claim:

1. In combination with an open casting wheel having a circumferential casting groove consisting of interior side walls and a bottom surface extending therebetween and defining a predetermined draft angle therewith, a combined wheel spreader and crack closer comprising means mounting said wheel spreader and crack closer in juxtaposed relation to the casting groove, means for applying pressure against said interior side walls during rotation of said casting wheel for removing metallic deposits and maintaining said predetermined draft angle, means for applying pressure against said bottom surface during rotation of said casting wheel for closing cracks and smoothing out flaws therein, and wherein said means for applying pressure against said interior side walls includes a split contoured roller adapted to bear in rolling contact simultaneously against said bottom surface and said side walls.

2. In combination with an open casting wheel having a circumferential casting groove consisting of interior side walls and a bottom surface extending therebetween and defining a predetermined draft angle therewith, a combined wheel spreader and crack closer comprising means mounting said wheel spreader and crack closer in juxtaposed relation to the casting groove, means for simultaneously applying pressure against said interior side walls and said bottom surface during rotation of said casting wheel and wherein said means for simultaneously applying pressure is a split contoured roller having edge portions thereof shaped to conform with and bear in rolling contact with said side walls and bottom surface.

3. In a continuous bar casting machine for continuous casting of copper bar and the like wherein said machine has a casting wheel which defines a casting groove having sidewalls and a bottom of generally U-shaped cross-sectional configuration in the periphery thereof, the improvement comprising, a wheel spreader, and means for mounting said wheel spreader for rotation and to have edge portions thereof in contact with said sidewalls of the peripheral groove to inhibit movement of said sidewalls toward one another and closing the groove.

* * * * *